United States Patent [19]

Arney

[11] Patent Number: 4,640,328

[45] Date of Patent: Feb. 3, 1987

[54] COLLAPSIBLE LIQUID CONTAINER PARTICULARLY FOR TRANSPORTATION BY HELICOPTER

[76] Inventor: Donald B. Arney, 1001 - 2191 W. 39th Ave., Vancouver, B.C., V6M 1T7, Canada

[21] Appl. No.: 610,831

[22] Filed: May 16, 1984

[51] Int. Cl.[1] ..... B65D 90/12; B64D 37/04

[52] U.S. Cl. ..... 150/55; 220/1 B; 220/5 A; 220/18.1; 220/401; 222/105; 222/181; 222/185; 244/135 B; 248/97; 248/431

[58] Field of Search ..... 150/55, 49; 220/85 B, 220/401, 404, 1 B, 5 A, 69, 18.1; 222/181, 184, 185, 105, 92; 248/163, 150, 97, 98, 431; 244/135 R, 135 B; 141/114, 364

[56] References Cited

U.S. PATENT DOCUMENTS

| | | | |
|---|---|---|---|
| 151,679 | 6/1874 | Benson | 248/97 |
| 554,071 | 2/1896 | Matzen | 215/11 E |
| 1,361,469 | 12/1920 | Kingsbury et al. | 248/163.2 |
| 1,866,175 | 7/1932 | Rogers, Jr. | 248/163.2 |
| 2,149,042 | 2/1939 | Branthover | 248/97 |
| 2,487,786 | 11/1949 | Bogle | 220/1 B |
| 3,101,921 | 8/1963 | Price | 244/135 B |
| 3,286,871 | 11/1966 | Eberline | 220/5 A |
| 3,374,929 | 3/1968 | Silfverskiold | 383/119 X |
| 3,409,714 | 11/1968 | Strugar, Jr. | 222/105 X |
| 3,661,211 | 5/1972 | Powers | 150/49 X |
| 3,893,595 | 7/1975 | Khanna et al. | 222/185 |
| 3,966,147 | 6/1976 | Wittho et al. | 244/135 B |
| 4,113,146 | 9/1978 | Williamson | 222/105 |
| 4,143,796 | 3/1979 | Williamson et al. | 222/185 |
| 4,188,005 | 2/1980 | Lee | 248/97 |
| 4,194,652 | 3/1980 | Williamson et al. | 222/185 |
| 4,223,797 | 9/1980 | Skakunov | 220/5 A |

FOREIGN PATENT DOCUMENTS

| | | | |
|---|---|---|---|
| 663314 | 12/1951 | United Kingdom | 244/135 B |
| 915999 | 1/1963 | United Kingdom | 383/22 |

*Primary Examiner*—William Price
*Assistant Examiner*—Bryon Gehman
*Attorney, Agent, or Firm*—Carver & Co.

[57] ABSTRACT

A collapsible liquid container apparatus, particularly for use with helicopters for carrying and storing fuel, has a bladder-like tank having closable ports to admit and discharge fuel. The apparatus has a frame to support the tank, and a harness cooperating with the tank and the frame to suspend the tank from the frame. Preferably, the frame has three legs and the tank is suspended between the three legs, and is restrained against excessive lateral movement relative to the frame. The harness includes a plurality of flexible tension links which extend from peripherally spaced locations on the tank. The locations are within a generally horizontal plane positioned approximately mid-way between uppermost and lowermost portions of the tank when filled to permit an upper portion of the tank to collapse inside a lower portion of the tank as the tank empties. The tank is suspended clear of obstructions on the ground, thus reducing chances of rupture, and when filled is easily transported beneath a helicopter due to its symmetrical shape. When emptied, it can be folded into a small volume and stored inside the helicopter.

14 Claims, 14 Drawing Figures

COLLAPSIBLE LIQUID CONTAINER PARTICULARLY FOR TRANSPORTATION BY HELICOPTER

BACKGROUND OF THE INVENTION

1. Field of the Invention

The invention relates to a collapsible liquid container, particularly for storing and transporting helicopter fuel, which can be easily transported by a helicopter.

2. Prior Art

A helicopter is severly limited in its range of operations by the volume of fuel consumed. Small helicopters can rarely carry sufficient fuel on board for normal work, and commonly the helicopter is required to carry external fuel, e.g. to sling steel fuel drums from the cargo hook, for transporting fuel to the work area. Commonly, at a work site where there has been extensive use of helicopters, many empty fuel drums accumulate and become a hazard due to residual fuel which is difficult to empty completely, and furthermore require considerable storage space. Because returning empty fuel drums back to base is time consuming, they are commonly left behind and it is estimated that there are millions of empty fuel drums scattered across the northern portions of Canada and Alaska.

Flexible, pillow bladder tanks have been used to store fuel but such tanks are prone to a rupture by rough handling and thus require extra protection. Such tanks are also difficult to empty completely of fuel as the discharge opening is not always at a lowermost point. If the bladder tanks are merely fitted in a conventional net sling beneath the helicopter, the tanks are commonly damaged when the helicopter lands, due to puncturing by sharp objects on the ground. To avoid this problem, the pillow tanks have been transported on pallets suspended from cables, but this arrangement can exhibit poor aerodynamic characteristics requiring the helicopter to fly at lower cruise speeds. Also, when the helicopter is returning to base with empty pillow tanks, the pillow tanks are bulky and do not fold easily, and thus are returned as an external load. If the empty pillow tanks are strapped to the pallet, they also exhibit poor aerodynamic characteristics requiring a relatively slow cruise speed.

SUMMARY OF THE INVENTION

The present invention reduces the difficulties and disadvantages of the prior art by providing a lightweight, easily collapsible flexible fuel tank, or other liquid container apparatus, which is symmetrical when filled, and has good aerodynamic charateristics when slung beneath a helicopter, thus enabling the helicopter to cruise at reasonable speeds. Furthermore, when the tank is emptied it can be collapsed and fitted completely within the helicopter, thus permitting the helicopter to return without an external load of an empty tank. In fact, many empty tanks of the invention can be fitted within the helicopter for economical return to base. When the container apparatus is assembled it supports the flexible tank clear of the ground, thus essentially eliminating chances of accidental rupturing of the tank. Furthermore the tank is supported on a relatively broad base reducing the chances of the tank tipping over on a non-level surface. Furthermore, because the bag is flexible and is sealed at the top, the bag collapses as it drains, and essentially all fuel can be drained from the tank, leaving minimal residual fuel in the tank and providing an easy visual indication of the volume of fuel remaining in the tank.

A collapsible liquid container according to the invention includes a bladder-like tank having closable port means to admit and discharge fluid. The apparatus is characterized by a frame to support the tank, and harness means cooperating with the tank and the frame to suspend the tank from the frame. Preferably, the means to discharge liquid is a lower port positioned adjacent a lower portion of the tank when the tank is supported by the frame. The frame has legs and the tank is suspended between the legs and preferably restraining means cooperate with the tank and the legs to limit lateral movement of the tank relative to the frame. The harness means includes a plurality of flexible tension links extending from peripherally spaced locations on the tank. The locations are disposed within a generally horizontal plane positioned approximately mid-way between uppermost and lowermost portions of the tank when filled, so as to permit an upper portion of the tank to collapse within a lower portion of the tank as the tank empties. The lower portion of the tank can have a plurality of longitudinally disposed sleeves having open upper ends and being spaced circumferentially about the tank. Each tension link can pass through a respective sleeve to resist lateral movement of the links relative to the tank.

A detailed disclosure following, relating to drawings, describes a preferred embodiment of the invention, which is capable of expression in structure other than that particularly described and illustrated.

DETAILED DISCLOSURE

FIGS. 1 through 5

Figure 1:
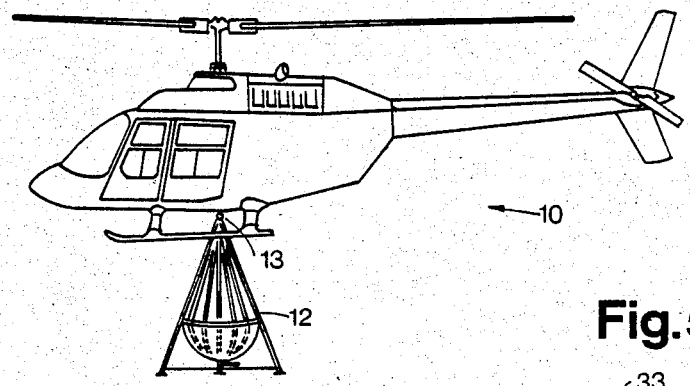
FIG. 1 is a simplified side elevation of a helicopter transporting a first embodiment of a filled liquid container apparatus according to the invention.

In FIG. 1, a helicopter 10 is shown carrying a collapsible liquid container apparatus 12 according to the invention, which is shown full and suspended from a cargo hook 13 of the helicopter.

Figure 3:
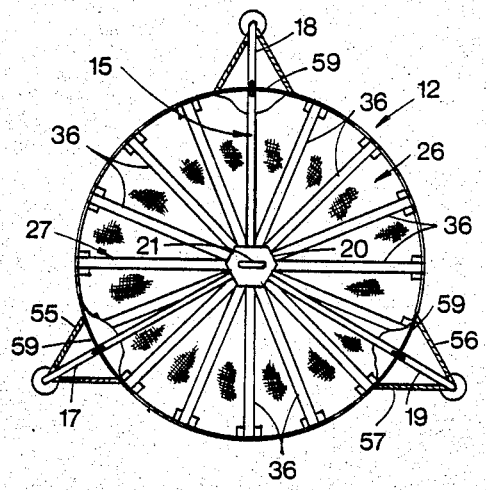
FIG. 3 is a simplified top plan view of the filled container apparatus.
Figure 2:
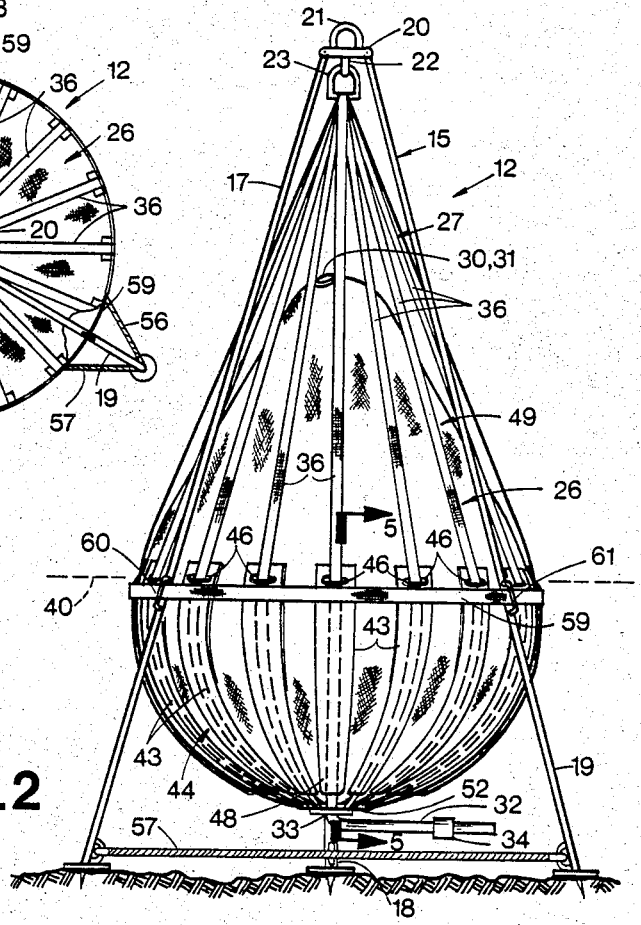
FIG. 2 is a simplified side elevation of the first embodiment of the invention, shown filled and supported on a generally horizontal surface.

Referring to FIGS. 2 and 3, the apparatus 12 has a collapsible frame 15, which is a tripod having three legs 17 through 19 which have upper ends connected together by an upper frame member 20. The upper member 20 has an upper ring 21, which connects with a suitable linkage, not shown, to the cargo hook hook 13, and a lower ring 22 which carries a connecting link 23. The apparatus includes a generally spherical, bladder-like tank 26 and a harness means 27 cooperating with the tank and the frame to suspend the tank from the frame. The tank 26 is fabricated from a flexible, impermeable fabric which assumes a pear shape when filled with liquid and supported by the harness. The tank has an upper opening or port 30 which can be closed by a complementary non-breather cap 31, and permits filling the tank with liquid or fuel, and visual inspection of the inside of the tank for condensation or other contaminants. The tank also has a lower opening or port 33 fitted with a discharge pipe 32 which has an inline pump and valve means 34 to control flow through the pipe as required.

Figure 5:
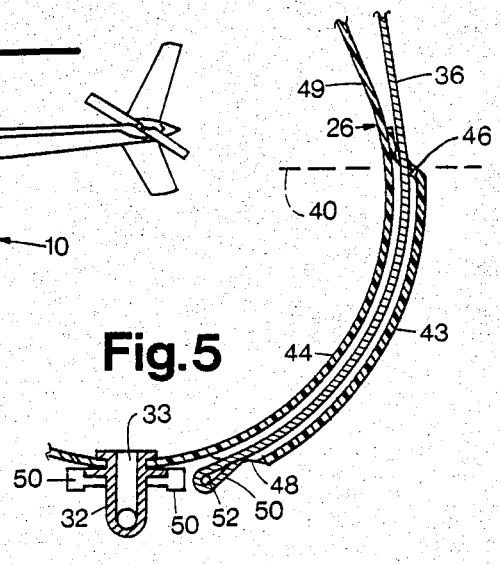
FIG. 5 is a simplified fragmented halfsection on line 5—5 of FIG. 2, some dimensions being exaggerated.
Figure 4:
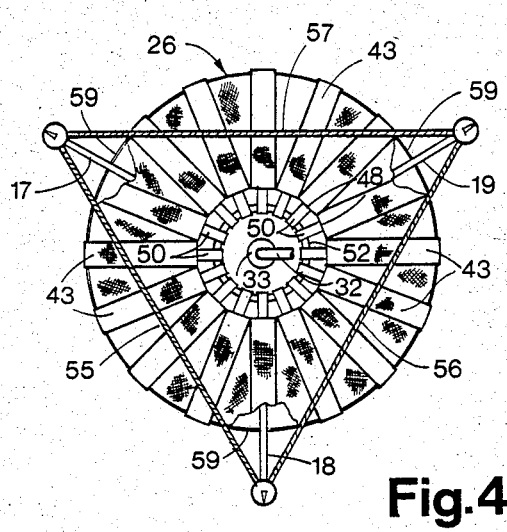
FIG. 4 is a simplified bottom plan of a lower portion of the apparatus.

The harness means 27 includes a plurality of flexible tension links 36, such as nylon webbing, which have upper portions engaged by the link 23 hanging from the lower ring 22 of the tripod to connect to the upper frame member. The tank has a lower portion 44 fitted with a plurality of longitudinally disposed sleeves 43. As seen also in FIG. 5, each sleeve has an open upper end 46, and extends downwardly towards a lowermost portion of the tank, to an open lower end 48 adjacent the discharge pipe 32. A lower portion of each tension link 36 passes through a respective sleeve 43. As seen in FIGS. 4 and 5, each link has a loop 50 which extends from an adjacent lower end 48. An anchor ring 52 is positioned adjacent the lowermost portion of the tank and interconnects the loops 50 of the lower portions of the tension links, so as to interconnect adjacent lower portions of the links to sustain most of the weight of the fuel within the tank. As seen in FIG. 4, the discharge pipe 32 is positioned within the anchor ring 52 and thus the harness means does not interfer with easy access to the discharge pipe.

Figure 9:
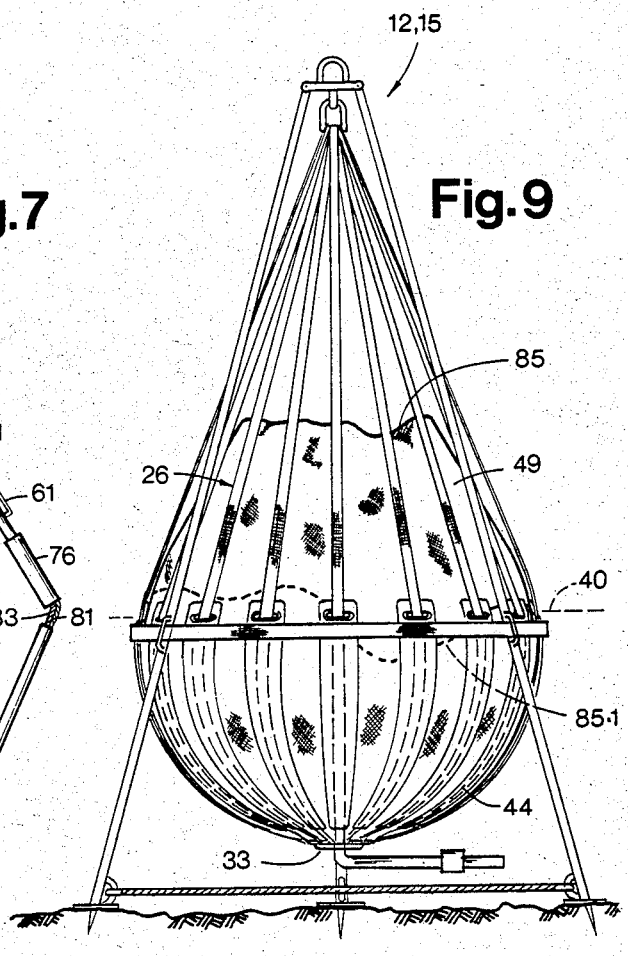
FIG. 9 is a simplified side elevation of a partially filled first embodiment of the container apparatus.

In FIG. 2, it can be seen that the sleeves locate the tension links relative to the tank so as to resist lateral movement of the tank. The open upper ends 46 of the sleeves are disposed within a generally horizontal plane 40 or tank central portion, which is positioned approximately midway between uppermost and lowermost portions of the tank when filled, that is approximately midway between the cap 31 and the discharge pipe 32 as measured along a "line of longitude" of the tank. In effect, the tension links of the harness extend upwardly and essentially clear of an upper portion 49 of the tank from peripherally spaced locations on the tank, the locations being disposed within the generally horizontal plane. The location of the plane is of particular importance as will be described with reference to FIG. 9.

Referring specifically to FIGS. 2 and 4, three equal lengths of cable, designated 55 through 57, extend between lower portions of the tripod legs 17 through 19. Thus, when the cables are taut, the ends of the legs are disposed at apices of an equilateral triangle as viewed from above and seen in FIGS. 3 and 4. This ensures equal spacing between the legs and limits spacing between ends of the legs. The lengths of cable 55 through 57 serve as limiting means and clearly other types of flexible tension links can be substituted for the cable. A loop 59 of broad webbing extends around the outside of the tripod legs to form an enclosure about half way between upper and lower ends of the tripod legs. This loop has a diameter which is somewhat less than that of the filled tank, where it actually encloses the tank. The loop 59 is located vertically by loop locators fitted on the three legs, the legs 17 and 19 having loop locators 60 and 61 as shown. The loop thus serves as a restraining means of flexible tension link which cooperates with the legs to form an enclosure which partially encloses the tank, so as to essentially restrict lateral movement of tank relative to the tripod. This is particularly important when the assembly is carried by the helicopter. As best seen in FIGS. 3 and 4, the tank when filled tends to bulge around the legs and this also assists in locating the tank between the legs. Clearly, as the tank empties, there is a greater tendency for the tank to swing between the legs, and the loop limits lateral movement or swinging of the tank relative to the tripod.

Figure 8:
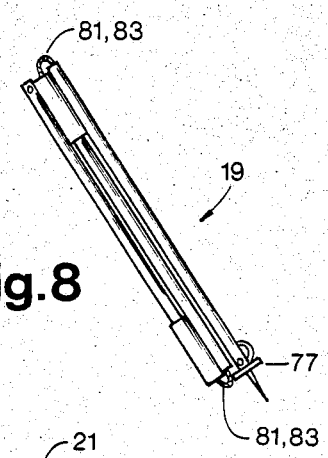
FIG. 8 is a simplified side elevation of the tripod leg fully collapsed for storage.
Figure 6:
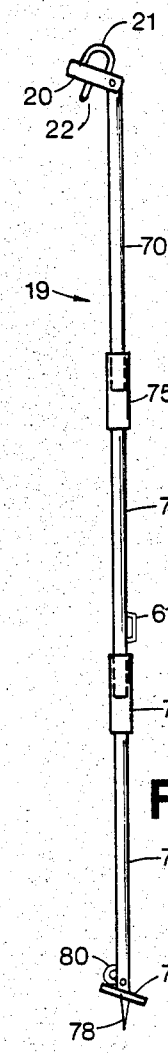
FIG. 6 is a simplified side elevation of one leg of a tripod in an extended position, an upper portion of the tripod being shown.
Figure 7:
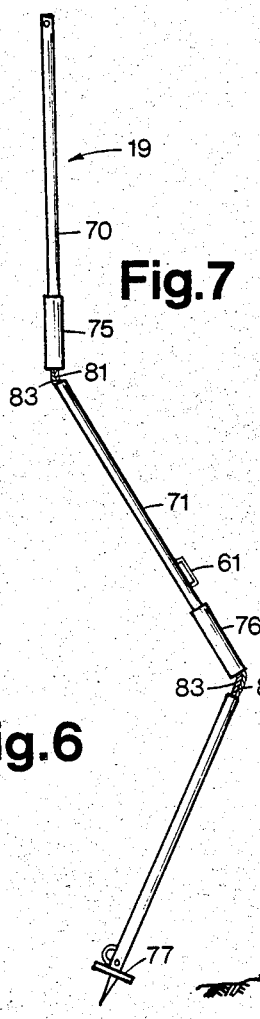
FIG. 7 is a simplified side elevation of the leg of the tripod shown partially disengaged.

FIGS. 6 through 8

The tripod legs or landing gear 17, 18 and 19 are essentially identical and thus only one leg, the leg 19, will be described in detail. The leg 19 has upper, intermediate and lower interfitting portions 70, 71 and 72. The portion 70 has an upper end pinned to the upper frame member 20 of the tripod which carries the upper and lower rings 21 and 22 as shown. The portion 70 has a sleeve 75 secured to the lower end to accept an upper end of the portion 71. Similarly, the portion 71 has a sleeve 76 secured thereto, which accepts an upper end of the portion 72 so that the portions can be aligned to provide a straight leg. The portion 72 has a foot 77 adjacent the lower end thereof, from which a spike 78 extends to penetrate soft ground. A ring 80 adjacent the foot receives the lengths of cable 56 and 57, as seen in FIG. 3.

Referring to FIG. 7, the sections 70, 71 and 72 can be separated axially to permit folding as shown in FIG. 8. The sections are tied together by an internally extending flexible safety cable 81 and an elastic cord or "bungee" 83. The elastic cord is normally maintained under tension to hold the portions in alignment as shown, but permits them to be collapsed as shown in FIG. 8, wherein adjacent portions are stacked end to end. The safety cable prevents total loss of portions of the leg should the elastic cord break.

FIG. 9

The invention has several advantages over the prior art flexible pillow bladder tanks, particularly relating to draining of the tank. Essentially all liquid fuel within the tank can drain easily, with negligible fuel collecting in fold or cavities, because the port 33 is positioned adjacent the lowermost portion of the tank when the tank is supported by the frame, and this position does not shift as the tank empties. This is beacuse the tank is designed to collapse as fuel is withdrawn, which collapsing is inevitable as the cap 31 is non-breathing and is maintained closed whilst the tank contains liquid. During emptying, the upper portion 49 of the tank assumes a profile 85, representing a position after about one quarter of the fuel within the tank has been withdrawn. As more fuel is withdrawn, the tank continues to collapse, so that the profile assumes a broken outline position 85.1 when about one quarter of fuel remains in the tank. It can be seen that the upper portion 49 of the tank can collapse gradually within the lower portion 44 of the tank as the tank empties. This gradual collapsing of the upper portion of the tank into the lower portion results from the specific location of the harness means. Because the flexible tension links extend from positions approximately half way between the uppermost and lowermost portions of the tank, the links do not restrict this collapsing because the tank (i.e. central portion) essentially folds in half into itself about its "equator". Clearly, if the flexible tension links extended from, or were secured to, the tank at positions above the locations shown, this securing would tend to restrict inward collapsing of the tank, which would increase the risk of residual fuel remaining in the tank due to uneven folding of the tank as the tank collapses.

OPERATION

Prior to filling, the tripod legs 17 through 19 are assembled and extended so that the restraining lengths of cable 55 through 57 become taut. The harness carrying the empty tank 26 is secured to the lower ring 22 and fuel is fed through the upper port 30, with the discharge pipe 32 being closed. As the tank fills, it automatically assumes a stable, low position within the tripod and the tension links can slide within the sleeves to accommodate smoothly the gradually increasing load within the tank. When the tank is completely filled, it bulges against the tripod legs and the loop 59, thus essentially preventing lateral movement of the tank within the tripod. A connecting link, now shown, extends between the upper ring 21 and the helicopter cargo hook 13, and the helicopter can then fly with the loaded fuel tank. Upon arrival at a work site, the helicopter can slowly lower the tripod onto essentially level ground whereupon the cargo hook can be released. Fuel can be easily withdrawn from the tank through the inline pump 34 and valve, the tank collapsing smoothly during this process. In contrast to rigid containers such as fuel cans, the volume of fuel within the tank of the invention can rapidly be ascertained with some degree of accuracy, by the actual size and shape of the tank when suspended. Clearly, as the tank empties, the overall volume noticably decreases, permitting rapid assessment of the remaining fuel. During emptying there is no requirement for a breather vent in the tank and thus fuel fumes are reduced.

When the tank is empty, the valve 34 can be closed, and the tank is essentially automatically already folded. The harness is released from the tripod, permitting the tank to be folded with its harness. The tripod legs are collapsed, and the resulting two folded items can be stored easily in the rear seats of the helicopter, or in the storage compartment.

ALTERNATIVES AND EQUIVALENTS

FIGS. 10–14

Figure 10:
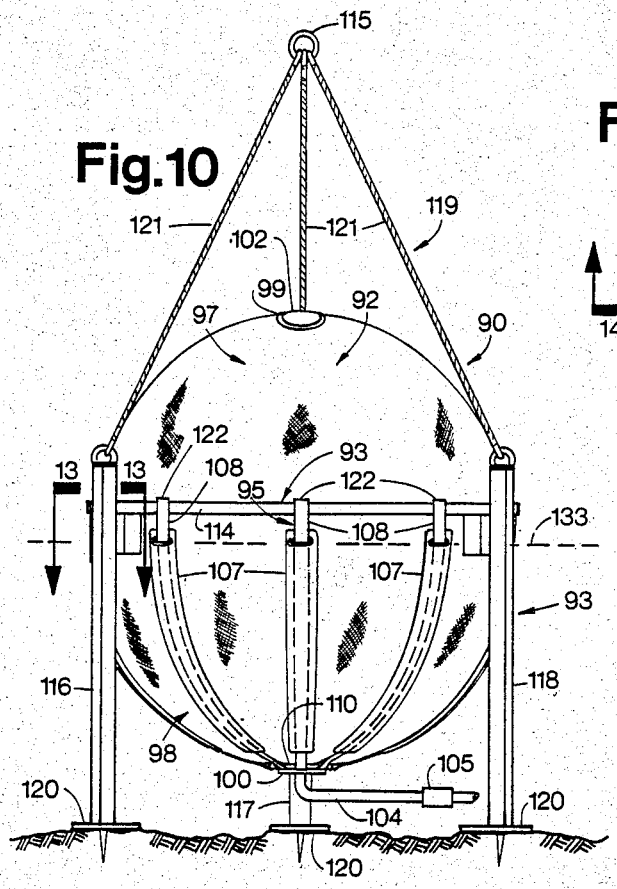
FIG. 10 is a simplified side elevation of a second embodiment of the invention, shown filled and supported on the ground.
Figure 11:
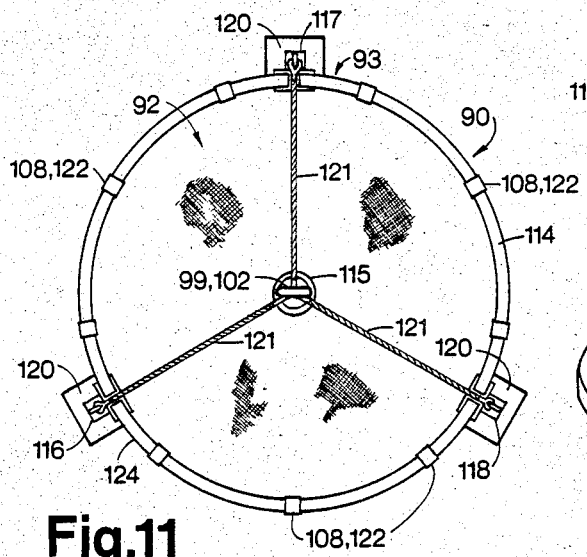
FIG. 11 is a simplified top plan view of the second embodiment.

Referring to FIGS. 10 and 11, a second embodiment 90 of the invention has a bladderlike tank 92, a frame 93 to support the tank, and a harness means 95 cooperating with the tank and the frame to suspend the tank from the frame. The tank has upper and lower portions 97 and 98 having respective upper and lower ports 99 and 100, the port 99 having a non-breathing cap 102, and the port 100 having a discharge pipe 104 and inline pump and valve 105. As before, the lower portion 98 has a plurality of sleeves 107 which accept flexible tension links 108 of the harness means which are threaded therethrough. Lower ends of the linke have loops, not clearly shown, which receive an anchor ring 110 to secure the lower end of the harness means in a manner similar to that as previously described. The frame 93 has a support member or upper frame member 114, which is a circular frame, and three legs or landing gear 116, 117 and 118 which extend downwardly from the support member to support the support member on the ground. The legs extend from positions spaced equally peripherally apart at 120 degrees around the frame, and are disposed generally vertically. The legs can be telescopically foldable, as previously described, and can be provided with a foot 120, which resists sinking into soft ground. A suspension means 119 has a ring 115 which can be attached to the cargo hook of the helicopter, and carries three equal cables 121 which extend downwardly to upper portions of the legs, and permit the frame to be hung from the helicopter for transportation. Upper portions of the links 108 of the harness means have loops 122 through which portions of the support member 114 are threaded as will be described. Thus, upper portions of the harness means cooperate with the support member to support the tank within the support member. The support member is shown as circular, but any generally horizontal, closed loop support member can be substituted. The tank has a size such that, when filled, it is closely enclosed by the frame which limits lateral movement of the tank relative to the frame and serves as a restraining means which is generally equivalent to the loop 50 of the first embodiment.

Figure 13:
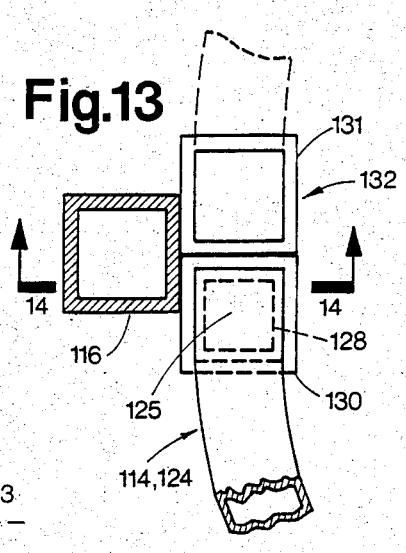
FIG. 13 is a simplified fragmented section on line 13—13 of FIG. 10.
Figure 14:
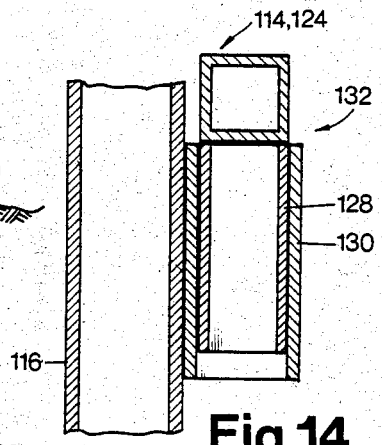
FIG. 14 is a simplified fragmented section on line 14—14 of FIG. 13.
Figure 12:
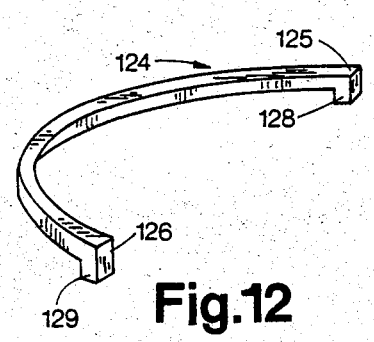
FIG. 12 is a perspective of a portion of a frame of the second embodiment.

Referring specifically to FIGS. 12 through 14, the support member 114 has three essentially equal arc portions, one arc portion 124 being shown in FIG. 12. The arc portion 124 has two similar opposite end portions 125 and 126 and extends over 120 degrees of arc, and the end portions coincide with the locations of the legs, as seen also in FIG. 11.

The portion 124 is square sectioned and the portions 125 and 126 have similarly square sectioned, downwardly protuding portions 128 and 129. The end portions of all the arc portions have similar downwardly protuding portions which are parallel to each other. The leg 116 has an upper portion having a pair of vertically disposed similar parallel sockets portions 130 and 131. The socket portion 130 is square sectioned and complementary to the protruding portion 128 which is inserted downwardly into the socket portion and retained therein by releaseable latch means, not shown, which can be either pins, spring-loaded latches or other known means. The complementary square sections essentially prevent rotation of the arc portion relative to the leg 116, and the length of the protruding portion 128 fitted closely within the socket portion 130 reduces lost motion between the support member and the leg. The socket portion 131 similarly receives a respective protruding portion from the adjacent arc portion. Adjacent ends of the three arc portions are retained in pairs in a similar manner at the top of each respective leg. It can be seen that the socket portions and protruding portions of the arc portions serve as connection means 132 cooperating with adjacent ends of two arc portions to form the circular frame, and each leg has an upper end portion cooperating with a respective connecting means.

Similarly to the first embodiment, the flexible tension links 108 extend from peripherally spaced locations on the tank 92, the locations being disposed within a generally horizontal plane or central portion 133 which is positioned approximately midway between uppermost and lowermost portions of the tank when filled. As previously described, this permits the upper portion 97 of the tanks to collapse within the lower portion 98 of the tank as the tank empties. As seen in FIGS. 10 or 11, each arc portion of the member 114 has three links 108 extending therefrom towards the anchor ring 110. Preferably, the central link of each arc portion is secured to the arc portion at the midpoint thereof, so as to prevent lateral sliding of the central link along the arc portion. The remaining two outer links can be freely mounted on the support member, and when folded can be slid towards the central link to provide a more compact bundle. The downwardly protruding portions at the end of each arc portion prevent the two outer links from sliding off the ends of the arc portions.

In operation, the tank functions in a manner similar to that as previously described. As the tank empties, the upper portion 97 collapses within the lower portion 98 and essentially all fuel can drain from the tank as the lower port 100 is adjacent to the lowermost position of the tank. When the tank is emptied, the ends of each arc portion are removed from the adjacent legs, so that the three legs 116 through 118 and the suspension means 119 form one package, and the tank 92, the harness means 95 and the three arc portions of the support member 114 form a second package for easy storage within the helicopter.

The tank disclosed are medium-to-large capacity tanks in which the actual fabric of the tank itself is relieved of most tensile forces by transferring the weight of the tank into the links of the harness means. In a third embodiment for smaller capacity tanks, the links can be attached directly to the fabric of the tank using known means to disperse stresses smoothly into the fabric. In the third embodiment, which is not illustrated, the sleeves, lower portions of the links and the anchor ring can be eliminated, and the lower ends of the links are secured to the tank at peripherally spaced locations on the tank. Similarly to the described embodiments, the locations are disposed within a generally horizontal plane positioned approximately mid-way between uppermost and lowermost portions of the tank when filled. This permits an upper portion of the tank to collapse within the lower portion of the tank as the tank empties as previously described.

If severe ambient temperature rises are expected, to reduce increased pressure forces on the tank, expansion allowance can be incorporated. One method of providing expansion allowance is to tighten slightly a belt around the "equator" of the tank to prevent over-filling, and then to close the cap. This will provide a degree of "slackness" in the tank fabric when the belt is removed, which slackness in turn will accomodate some expansion of fluid in the tank with reduced fabric stress.

I claim:

1. A flexible fully collapsible and emptyable fluid container apparatus for aerial transport or the like comprising:

(a) a collapsible container having a first upper portion and a second lower portion and a third central portion;

(b) ground engageable support means for supporting said container;

(c) said first upper portion of said container having a first collapsed position when said container is empty and a second expanded position when said container is full;

(d) said second lower and said third central portions having a substantially bowl-like configuration at all times;

(e) said support means including rigid means engageable with said third central portion for maintaining said second lower and said third central portions in said bowl-like configuration at all times;

(f) said first upper position of said container including means for permitting said first upper portion to collapse fully into said bowl-like configuration of said second lower and said third central portions whereby, when said first upper portion is fully collapsed into said second central and said third lower portions, said container is fully emptied and said fully collapsed position can be observed by visual inspection to confirm full drainage of fluid in the container;

(g) said ground engageable support means includes three legs;

(h) said rigid means connects said three legs together; and, (i) harness means cooperating with said container and said ground engageable support means to suspend the container from the support means.

2. A fluid container apparatus according to claim 1, wherein:

(a) said harness means includes a plurality of flexible tension lengths having upper portions cooperating with said rigid means.

3. A flexible fully collapsible and emptyable fluid container apparatus for aerial transport or the like, comprising:

(a) a collapsible container having a first upper portion and a second lower portion and a third central portion;

(b) ground engageable support means for supporting said container;

(c) said first upper portion of said container having a first collapsed position when said container is empty and a second expanded position when said container is full;

(d) said second lower and third central portions having a substantially bowl-like configuration at all times;

(e) said support means including rigid means engageable with said third central portion for maintaining said second lower and said third central portions in said bowl-like configuration at all times;

(f) said first upper portion of said container including means for permitting said first upper portion to collapse fully into said bowl-like configuration of said second lower and third central portions whereby, when said first upper portion is fully collapsed into said second central and third lower portions, said container is fully emptied and said fully collapsed position can be observed by visual inspection to confirm full drainage of fluid in the container;

(g) harness means cooperating with said container and said ground engageable support means to suspend the container from the support means.

4. A fluid container apparatus according to claim 3, wherein:

(a) said harness means includes a plurality of flexible tension lengths having upper portions cooperating with said rigid means.

5. A flexible fully collapsible and emptyable fluid container apparatus for aerial transport, comprising:

(a) a collapsible container having a first upper portion and a second lower portion and a third central portion;

(b) ground engageable support means for supporting said container;

(c) said first upper portion of said container having a first collapsed position when said container is empty and a second expanded position when said container is full;

(d) said second lower and third central portions having a substantially bowl-like configuration at all times;

(e) said support means including rigid means engageable with said third central portion for maintaining said second lower and said third central portions in said bowl-like configuration at all times;

(f) said first upper portion of said container including means for permitting said first upper portion to collapse fully into said bowl-like configuration of said second lower and third central portions whereby, when said first upper portion is fully collapsed into said second central and third lower portions, said container is fully emptied and said fully collapsed position can be observed by visual inspection from above to confirm full drainage of fluid in the container;

(g) means in said lower portion for emptying said container;

(h) means in said first upper portion for filling said container including non-breather means permitting said upper portion to collapse against said second lower and third central portions as a result of the vacuum created in said container as said container is emptied;

(i) said ground engageable support means includes three legs;

(j) said rigid means connects said three legs together; and, (k) harness means cooperating with said container and said ground engageable support means to suspend the container from said support means.

6. The container of claim 5, wherein said ground engageable support means includes:

(a) a frame;

(b) said frame including an upper frame member connecting said legs together in spaced circumferential relationship so that said frame is self-supporting;

(c) said container including a plurality of longitudinally disposed sleeves adjacent said container lower portion, said sleeves being spaced circumferentially about said container and each sleeve having an open upper end portion disposed below the uppermost portion of said container; and, (d) harness means having a plurality of flexible tension links, each tension link having an upper end portion cooperating with said upper frame member for suspending said harness means therefrom and each tension link having a lower portion adjacent said container lower portion for supporting said container thereon and each tension link extending through one of said sleeves from the open end portion thereof to said upper frame member and said sleeves positioning said tension links for resisting lateral movement of said links relative to said container and for transferring load from said container to said links for reducing stress from said harness means on said container.

7. The container of claim 6, wherein:

(a) said upper frame member including a generally horizontal closed loop support member and said legs extending downwardly from said closed loop support member for supporting said closed loop support member above the ground; and, (b) the upper end portion of each tension link cooperating with said closed loop support member for supporting said container.

8. The container of claim 7, wherein:

(a) said closed loop support member including a circular frame; and, (b) said legs being disposed equiangularly about said circular frame.

9. The container of claim 8, wherein:

(a) said closed loop support member having three essentially equal arc portions, each arc portion having two opposite ends and extending over substantially 120°;

(b) three connection means, each connection means cooperating with the adjacent ends of adjacent arc portions for forming said circular frame; and, (c) each leg having an upper portion cooperating with one of said connection means and a lower portion for supporting said frame on the ground.

10. A fluid container apparatus according to claim 5, wherein:

(a) said harness means includes a plurality of flexible tension lengths having upper portions cooperating with said rigid means.

11. A fluid container apparatus according to claim 5, wherein:

(a) said three legs of said ground engageable support means forming a tripod, in which said three legs are connected together at upper ends thereof; and, (b) said upper portions of said harness means cooperating with said rigid member so that said container is suspended between said three legs of said tripod.

12. A fluid container apparatus according to claim 5, wherein:

(a) said ground engaging support means includes three legs extending downwardly from said rigid means.

13. A fluid container apparatus according to claim 5, wherein:

(a) said ground engageable support means including means to support the collapsible and emptyable container above the ground.

14. A fluid container apparatus according to claim 5, wherein:

(a) said ground engageable support means includes landing gear means for engaging the ground from an airborne position and for maintaining said container above the ground while said landing gear means is in contact with the ground.

* * * * *